US011644033B2

(12) United States Patent
Lee et al.

(10) Patent No.: US 11,644,033 B2
(45) Date of Patent: May 9, 2023

(54) SCROLL COMPRESSOR

(71) Applicant: Hanon Systems, Daejeon (KR)

(72) Inventors: Kyung Jae Lee, Daejeon (KR); Jeong Ki Seo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 4 days.

(21) Appl. No.: 17/311,471

(22) PCT Filed: Jan. 16, 2020

(86) PCT No.: PCT/KR2020/000815
§ 371 (c)(1),
(2) Date: Jun. 7, 2021

(87) PCT Pub. No.: WO2020/153661
PCT Pub. Date: Jul. 30, 2020

(65) Prior Publication Data

US 2022/0025885 A1 Jan. 27, 2022

(30) Foreign Application Priority Data

Jan. 21, 2019 (KR) ..... 10-2019-0007316

(51) Int. Cl.
*F04C 18/02* (2006.01)
*F04C 23/00* (2006.01)
*F04C 29/06* (2006.01)

(52) U.S. Cl.
CPC ..... *F04C 18/0215* (2013.01); *F04C 18/0261* (2013.01); *F04C 18/0269* (2013.01); *F04C 23/008* (2013.01); *F04C 29/068* (2013.01); *F04C 2240/30* (2013.01)

(58) Field of Classification Search
CPC ..... F04C 18/0253; F04C 18/0246
See application file for complete search history.

(56) References Cited

U.S. PATENT DOCUMENTS 4,435,137 A * 3/1984 Terauchi ..... F04C 29/0021 418/57
5,607,288 A * 3/1997 Wallis ..... F04C 18/0215 417/310

(Continued)

FOREIGN PATENT DOCUMENTS

CN 108291540 A 7/2018
CN 108884828 A 11/2018

(Continued)

*Primary Examiner* — Devon C Kramer
*Assistant Examiner* — Wesley G Harris
(74) *Attorney, Agent, or Firm* — Shumaker, Loop & Kendrick, LLP; James D. Miller

(57) ABSTRACT

A scroll compressor includes a casing; an orbiting scroll; a fixed scroll; and a main frame which supports the orbiting scroll. The fixed scroll may include a fixed scroll end plate and a fixed scroll wrap which protrudes from the fixed scroll end plate. The main frame may include a main frame end plate which is provided on the opposite side of the fixed scroll end plate on the basis of the orbiting scroll, and a main frame side plate which protrudes from an outer circumferential portion of the main frame end plate toward the fixed scroll. The fixed scroll end plate, the main frame end plate, and the main frame side plate may form an orbiting space of the orbiting scroll.

12 Claims, 9 Drawing Sheets

(56) References Cited

U.S. PATENT DOCUMENTS

| | | | | |
|---|---|---|---|---|
| 2003/0156954 | A1* | 8/2003 | Kimura | H01R 13/6592 417/410.5 |
| 2006/0233657 | A1* | 10/2006 | Bonear | F04C 28/28 418/55.6 |
| 2011/0129377 | A1* | 6/2011 | Huang | F04C 23/008 418/55.1 |
| 2013/0294951 | A1* | 11/2013 | Ishikawa | F04B 39/121 417/410.5 |
| 2017/0292517 | A1* | 10/2017 | Lee | F04C 18/0215 |

FOREIGN PATENT DOCUMENTS

| | | | |
|---|---|---|---|
| JP | H07259760 | A | 10/1995 |
| JP | 2005273501 | A | 10/2005 |
| JP | 2008008285 | A | 1/2008 |
| JP | 2013060937 | A | 4/2013 |
| JP | 2013245555 | A | 12/2013 |
| JP | 6305536 | B2 | 4/2018 |
| KR | 20170035748 | A | 3/2017 |
| KR | 20170139392 | A | 12/2017 |
| KR | 101905395 | B1 | 10/2018 |
| KR | 20180117469 | A | 10/2018 |
| WO | 2017168673 | A1 | 10/2017 |

* cited by examiner

FIG. 1 – PRIOR ART

SCROLL COMPRESSOR

CROSS-REFERENCE TO RELATED PATENT APPLICATIONS

This patent application is a United States national phase patent application based on PCT/KR2020/000815 filed on Jan. 16, 2020, which claims the benefit of Korean Patent Application No. 10-2019-0007316 filed on Jan. 21, 2019, the entire contents of both of which are hereby incorporated herein by reference.

TECHNICAL FIELD

The present disclosure relates to a scroll compressor and more particularly to a scroll compressor capable of compressing a refrigerant by a fixed scroll and an orbiting scroll.

BACKGROUND ART

In general, a vehicle is equipped with an air conditioning (A/C) system for heating and cooling the interior of the vehicle. Such an air conditioning system includes a compressor as a component of the cooling system. The compressor compresses a low-temperature and low-pressure gaseous refrigerant introduced from an evaporator into a high-temperature and high-pressure gaseous refrigerant, and transfers it to a condenser.

There are two types of compressors, that is to say, a reciprocating type compressor which compresses a refrigerant according to a reciprocating motion of a piston and a rotary type compressor which compresses a refrigerant while performing a rotational motion. The reciprocating type compressor includes a crank type compressor which transmits a driving force of a driving source to a plurality of pistons by using a crank and a swash plate type compressor which transmits a driving force of a driving source to a rotating shaft with the swash plate installed therein, etc., in accordance with a transmission method of the driving source. The rotary type compressor includes a vane rotary type using a rotating shaft and a vane, and a scroll type compressor using an orbiting scroll and a fixed scroll.

The scroll compressor is widely used for refrigerant compression in air conditioners, etc., because the scroll compressor can obtain a relatively high compression ratio compared to other types of compressors and can obtain a stable torque thanks to smooth connection of the suction, compression, and discharge strokes of the refrigerant.

FIG. 1 is a cross-sectional view showing a conventional scroll compressor.

Referring to accompanying FIG. 1, a conventional scroll compressor includes a housing 10, a motor 20 generating a rotational force within the housing 10, a rotary shaft 30 which is rotated by the motor 20, an orbiting scroll 50 which performs an orbiting motion by the rotary shaft 30, and a fixed scroll 60 which is meshed with the orbiting scroll 50 to form a pair of two compression chambers C.

The housing 10 includes a center housing 12, a front housing 14 which is fastened to the center housing 12 to form a first space S1 in which the motor 20 is received, and a rear housing 16 is fastened to the center housing 12 on the opposite side of the front housing 14 on the basis of a center housing end plate 12*a* to form a second space S2 in which the orbiting scroll 50 and the fixed scroll 60 are received.

The center housing 12 includes the center housing end plate 12*a* which supports the orbiting scroll 50 and a center housing side plate 12*b* which protrudes from the outer circumferential portion of the center housing end plate 12*a* toward the front housing 14.

One end of the rotary shaft 30 passes through the center side of the center housing end plate 12*a*.

The front housing 14 includes a front housing end plate 14*a* which is opposed to the center housing end plate 12*a* and supports the other end of the rotary shaft 30, and a front housing side plate 14*b* which protrudes from the outer circumferential portion of the front housing end plate 14*a*, is fastened to the center housing side plate 12*b*, and supports the motor 20.

Here, the center housing end plate 12*a*, the center housing side plate 12*b*, the front housing end plate 14*a*, and the front housing side plate 14*b* form the first space S1. In order that the motor 20 can be inserted into the first space S1, the center housing 12 and the front housing 14 are formed separately and then fastened to each other. Here, since leakage may occur between the center housing 12 and the front housing 14, a first sealing member 70 for sealing the first space S1 from the outside of the housing 10 is interposed between the front housing side plate 14*b* and the center housing side plate 12*b*.

The rear housing 16 includes a rear housing end plate 16*a* which faces the center housing end plate 12*a* and a rear housing side plate 16*b* which protrudes from the outer circumferential portion of the rear housing end plate 16*a* and is fastened to the outer circumferential portion of the center housing end plate 12*a*.

Also, the rear housing 16 further includes a discharge chamber D which receives the refrigerant discharged from the compression chamber C.

Here, the center housing end plate 12*a*, the rear housing end plate 16*a*, and the rear housing side plate 16*b* form the second space S2. In order that the orbiting scroll 50 and the fixed scroll 60 can be inserted into the second space S2, the center housing 12 and the rear housing 16 are formed separately and then fastened to each other. Here, since leakage may occur between the center housing 12 and the rear housing 16, a second sealing member 80 for sealing the second space S2 from the outside of the housing 10 is interposed between the center housing end plate 12*a* and the rear housing side plate 16*b*.

The motor 20 includes a stator which is fixed to the front housing side plate 14*b* and a rotor which is rotated within the stator by interaction with the stator.

The rotary shaft 30 is fastened to the rotor and passes through the central portion of the rotor, so that one end of the rotary shaft 30 passes through the center housing end plate 12*a* and is fastened to an eccentric bush 40 which causes the orbiting scroll 50 to orbit. The other end of the rotary shaft 30 is supported by the front housing end plate 14*a*.

The orbiting scroll 50 includes a disk-shaped orbiting scroll end plate 52, an orbiting scroll wrap 54 which protrudes from the center of the orbiting scroll end plate 52 toward the fixed scroll 60, and an orbiting scroll boss 530 which protrudes from the orbiting scroll end plate 52 to the opposite side of the orbiting scroll wrap 54 and is fastened to the eccentric bush 40.

The fixed scroll 60 includes a disk-shaped fixed scroll end plate 62, a fixed scroll wrap 64 which protrudes from the center of the fixed scroll end plate 62 and is meshed with the orbiting scroll wrap 54, and a fixed scroll side plate 66 which protrudes from the outer circumferential portion of the fixed scroll end plate 62 and is fastened to the center housing end plate 12*a*.

Here, in order that noise generated in the compression chamber C is prevented from being emitted to the outside of the housing 10, the orbiting scroll 50 and the fixed scroll 60 are received within the housing 10, and the center housing end plate 12*a*, the fixed scroll end plate 62, and the fixed scroll side plate 66 form an orbiting space of the orbiting scroll 50. The fixed scroll side plate 66 is interposed between the rear housing side plate 16*b* and the orbiting scroll 50.

However, such a conventional scroll compressor had difficulty in increasing the discharge amount of the refrigerant in a state in which the orbiting scroll 50 and the fixed scroll 60 are received within the housing 10. Specifically, in order to increase the refrigerant discharge amount, an orbiting radius of the orbiting scroll 50 must be increased or the height of the compression chamber C in the axial direction must be increased. However, as the fixed scroll side plate 66 is formed between the rear housing side plate 16*b* and the orbiting scroll 50, it is difficult for the orbiting radius of the orbiting scroll 50 to be increased within the housing 10 which has a predetermined size. In particular, the fixed scroll side plate 66 includes a fastening hole (not shown) through which a fastening member (not shown) for fastening the fixed scroll 60 to the center housing end plate 12*a* passes. Also, the fixed scroll side plate 66 is formed thicker than the rear housing side plate 16*b* in order to prevent the reduction of rigidity of the fixed scroll side plate 66 due to the fastening hole (not shown). Therefore, it is more difficult for the orbiting radius of the orbiting scroll 50 to be increased. When a distance between the orbiting scroll end plate 52 and the fixed scroll end plate 62 is increased and when the height of the orbiting scroll wrap 54 and the height of the fixed scroll wrap 64 are increased, the durability of the orbiting scroll 50 and the fixed scroll 60 is significantly reduced, so that it is difficult for the height of the compression chamber C in the axial direction to be increased.

SUMMARY

Accordingly, the purpose of the present invention is to provide a scroll compressor capable of increasing the discharge amount of the refrigerant in a state in which the orbiting scroll and the fixed scroll are received within a casing.

One embodiment is a scroll compressor including: a casing; a motor which generates a rotational force within the casing; a rotary shaft which is rotated by the motor; an orbiting scroll which performs an orbiting motion by means of the rotary shaft; a fixed scroll which is meshed with the orbiting scroll and forms a pair of two compression chambers; and a main frame which supports the orbiting scroll. The fixed scroll includes a fixed scroll end plate and a fixed scroll wrap which protrudes from the fixed scroll end plate. The main frame includes a main frame end plate which is provided on the opposite side of the fixed scroll end plate on the basis of the orbiting scroll, and a main frame side plate which protrudes from an outer circumferential portion of the main frame end plate toward the fixed scroll. The fixed scroll end plate, the main frame end plate, and the main frame side plate form an orbiting space of the orbiting scroll.

The main frame side plate may be interposed between the casing and the orbiting scroll. The orbiting scroll may be formed to face the main frame side plate in a radial direction.

The main frame side plate may be formed thinner than the casing.

The fixed scroll may further include a fixed scroll flange which protrudes from an outer circumferential surface of the fixed scroll end plate in a radial direction and is fastened to the casing.

The main frame may further include a main frame flange which protrudes from an outer circumferential surface of the main frame side plate in a radial direction and is fastened to the casing.

The casing may include: a first casing which has a receiving space in which the motor, the rotary shaft, the orbiting scroll, the fixed scroll, and the main frame are received; and a second casing which is fastened to the first casing and covers the receiving space.

The first casing may include: a first casing end plate which supports an end of the rotary shaft; and a first casing side plate which protrudes from an outer circumferential portion of the first casing end plate toward the second casing and supports the motor, the main frame, and the fixed scroll.

The first casing side plate may include a flange insertion groove into which the fixed scroll flange and the main frame flange are inserted.

The flange insertion groove may include: a flange insertion groove basal surface which is bent from an inner circumferential surface of the first casing side plate; and a flange insertion groove inner circumferential surface which is bent from the flange insertion groove basal surface and extends to a front end surface of the first casing side plate.

The main frame flange may include: a main frame flange basal surface which contacts with the flange insertion groove basal surface; a main frame flange outer circumferential surface which is bent from the main frame flange basal surface and faces the flange insertion groove inner circumferential surface; and a main frame flange top surface which is bent from the main frame flange outer circumferential surface and forms a back side of the main frame flange basal surface.

The fixed scroll flange may include: a fixed scroll flange basal surface which contacts with the main frame flange top surface; a fixed scroll flange outer circumferential surface which is bent from the fixed scroll flange basal surface and faces the flange insertion groove inner circumferential surface; and a fixed scroll flange top surface which is bent from the fixed scroll flange outer circumferential surface and forms a back side of the fixed scroll flange basal surface.

The fixed scroll flange may include a first fastening hole which passes through the fixed scroll flange from the fixed scroll flange top surface to the fixed scroll flange basal surface. The main frame flange may include a second fastening hole which passes through the main frame flange from the main frame flange top surface to the main frame flange basal surface. The flange insertion groove may include a third fastening hole which is formed engraved from the flange insertion groove basal surface. The main frame flange and the fixed scroll flange may be fastened to the first casing side plate by a fastening member that is inserted into the first fastening hole, the second fastening hole, and the third fastening hole.

The motor, the rotary shaft, the orbiting scroll, the fixed scroll, and the main frame may be inserted from the second casing side into the first casing side, and then may be received in the receiving space.

The sealing member which seals the receiving space from the outside of the casing may be formed between the first casing and the second casing. The receiving space may be sealed only by the sealing member.

The scroll compressor may further include an oil recovery passage which recovers oil which is separated from a refrigerant discharged from the compression chamber. The oil recovery passage may be formed on the main frame side plate.

The scroll compressor according to the embodiment of the present invention includes a casing; a motor which generates a rotational force within the casing; a rotary shaft which is rotated by the motor; an orbiting scroll which performs an orbiting motion by means of the rotary shaft; a fixed scroll which is meshed with the orbiting scroll and forms a pair of two compression chambers; and a main frame which supports the orbiting scroll. The fixed scroll includes a fixed scroll end plate and a fixed scroll wrap which protrudes from the fixed scroll end plate. The main frame includes a main frame end plate which is provided on the opposite side of the fixed scroll end plate on the basis of the orbiting scroll, and a main frame side plate which protrudes from an outer circumferential portion of the main frame end plate toward the fixed scroll. The fixed scroll end plate, the main frame end plate, and the main frame side plate form an orbiting space of the orbiting scroll. Accordingly, the orbiting radius of the orbiting scroll is increased within the casing which has a predetermined size, and thus, the discharge amount of the refrigerant can be increased in a state in which the orbiting scroll and the fixed scroll are received within the casing.

DETAILED DESCRIPTION OF AN EMBODIMENT

Hereinafter, a scroll compressor according to the present disclosure will be described in detail with reference to the accompanying drawings.

Figure 1:
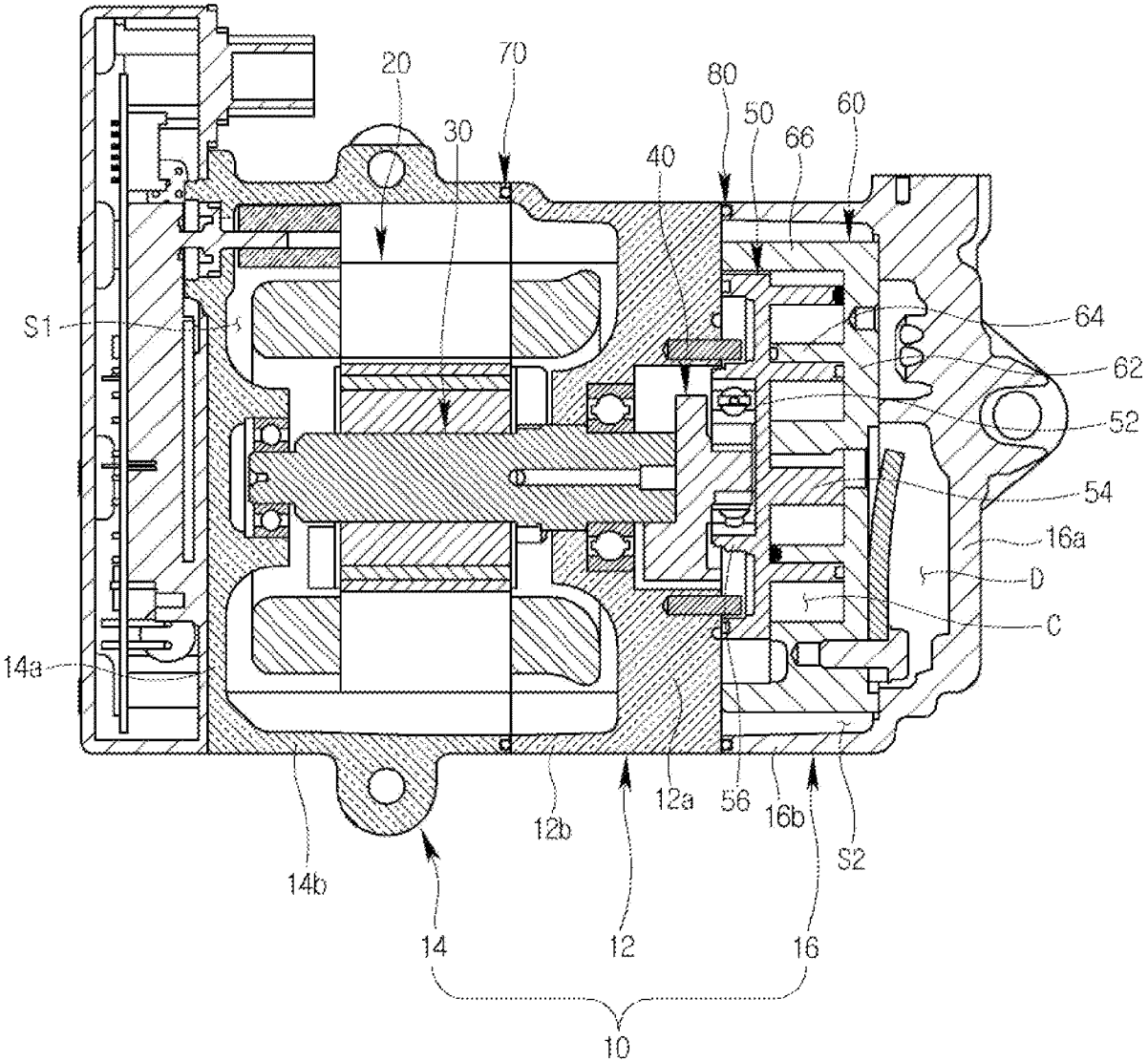
FIG. 1 is a cross-sectional view showing a conventional scroll compressor.
Figure 2:
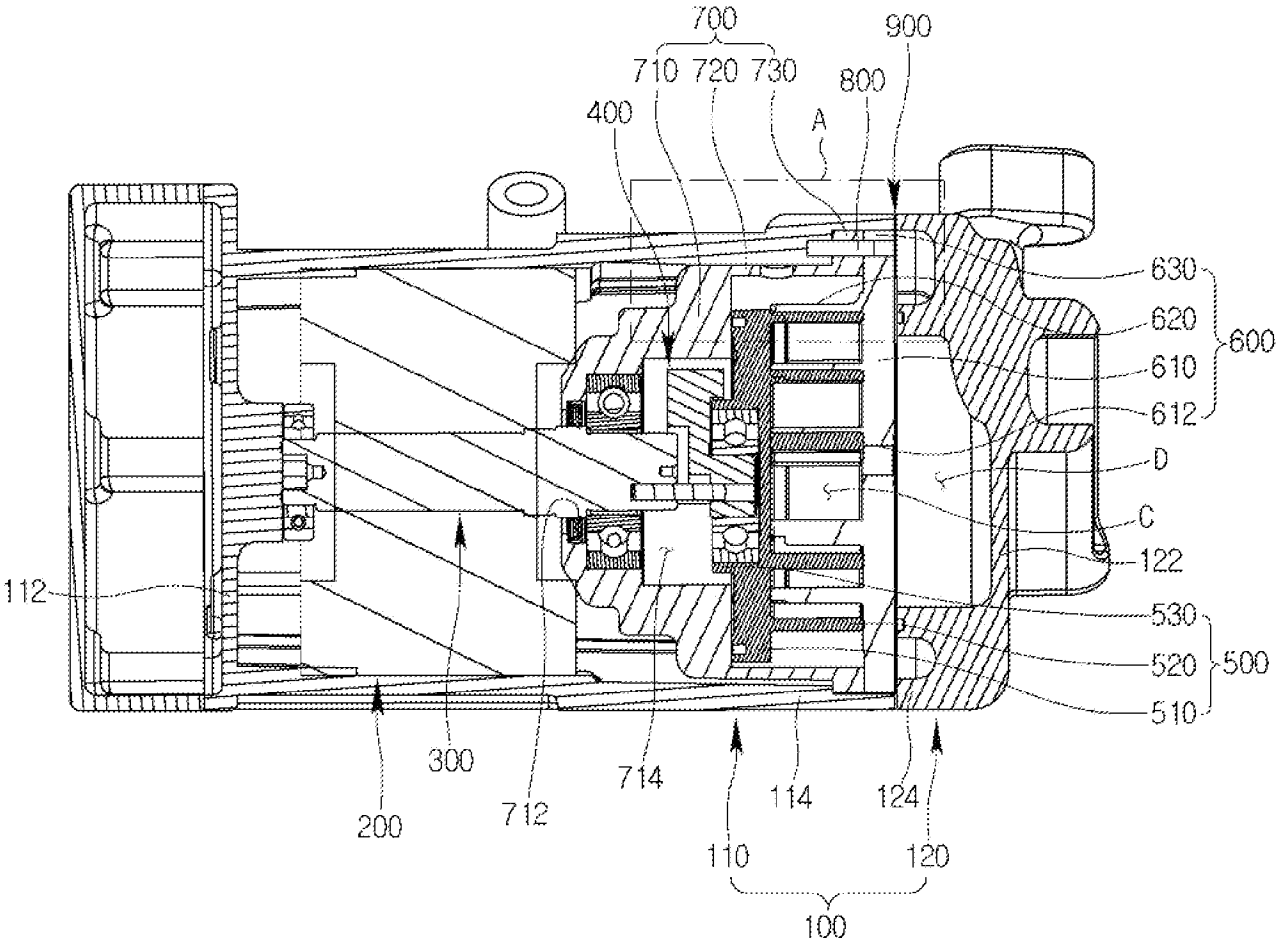
FIG. 2 is a cross-sectional view showing a scroll compressor according to an embodiment of the present invention.
Figure 3:
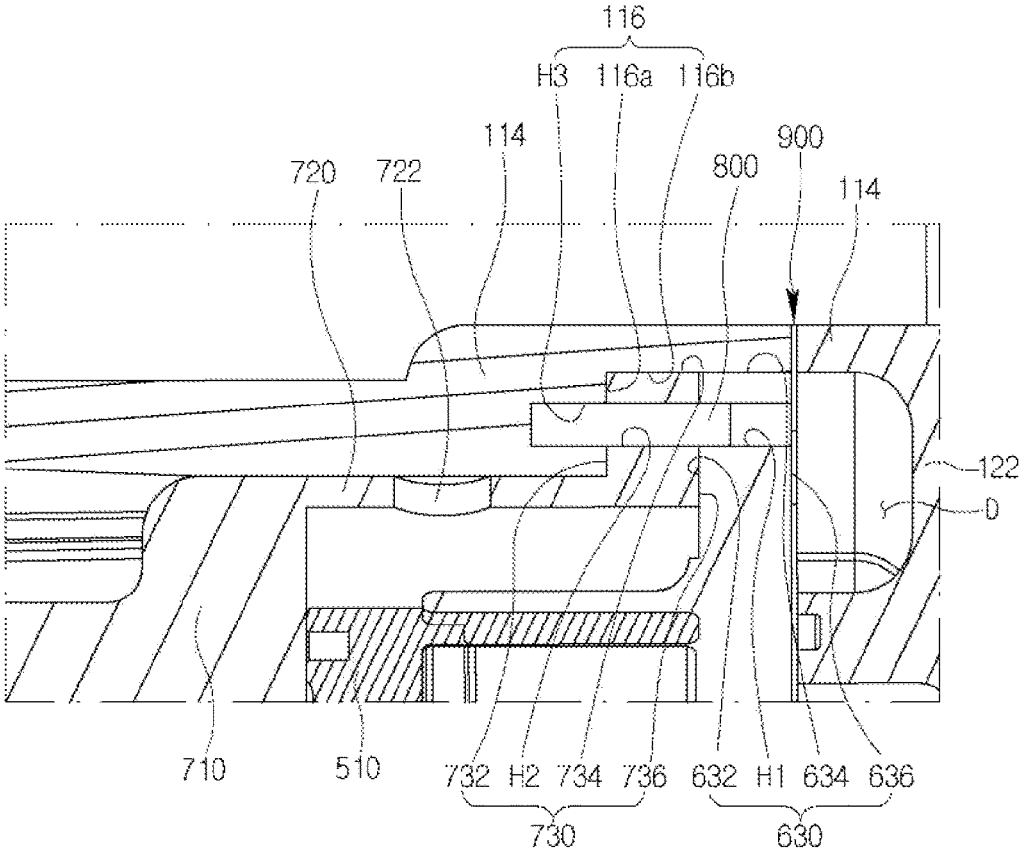
FIG. 3 is an enlarged view of a part "A" of FIG. 2.
Figure 4:
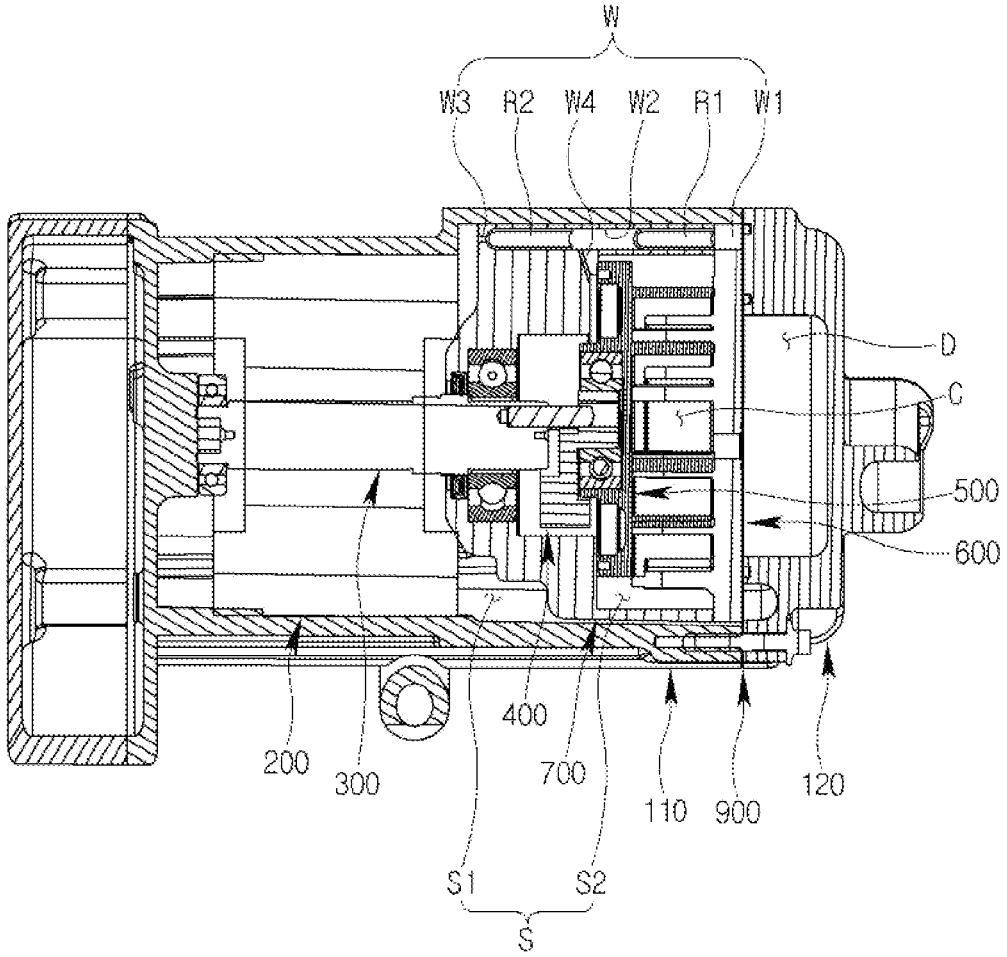
FIG. 4 is a cross sectional view showing the scroll compressor of FIG. 2 cut in another direction.
Figure 5:
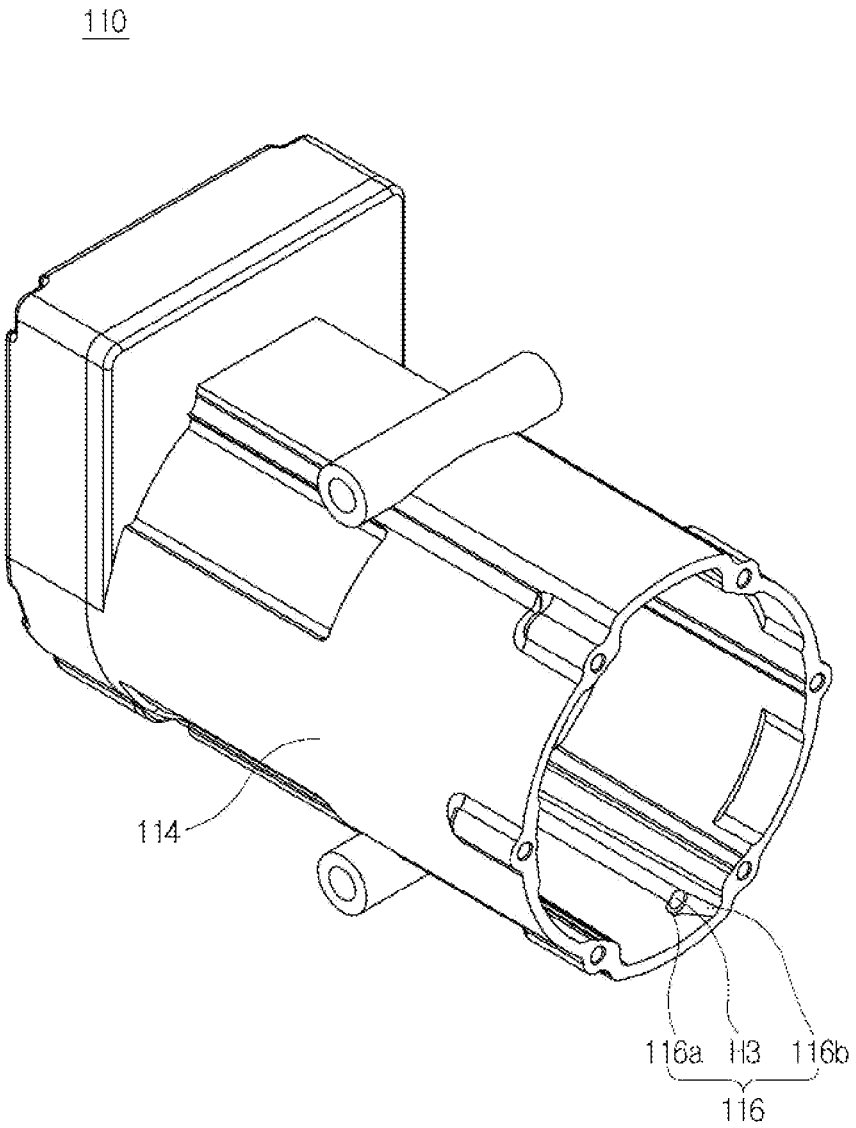
FIG. 5 is a perspective view showing a first casing in the scroll compressor of FIG. 2.
Figure 6:
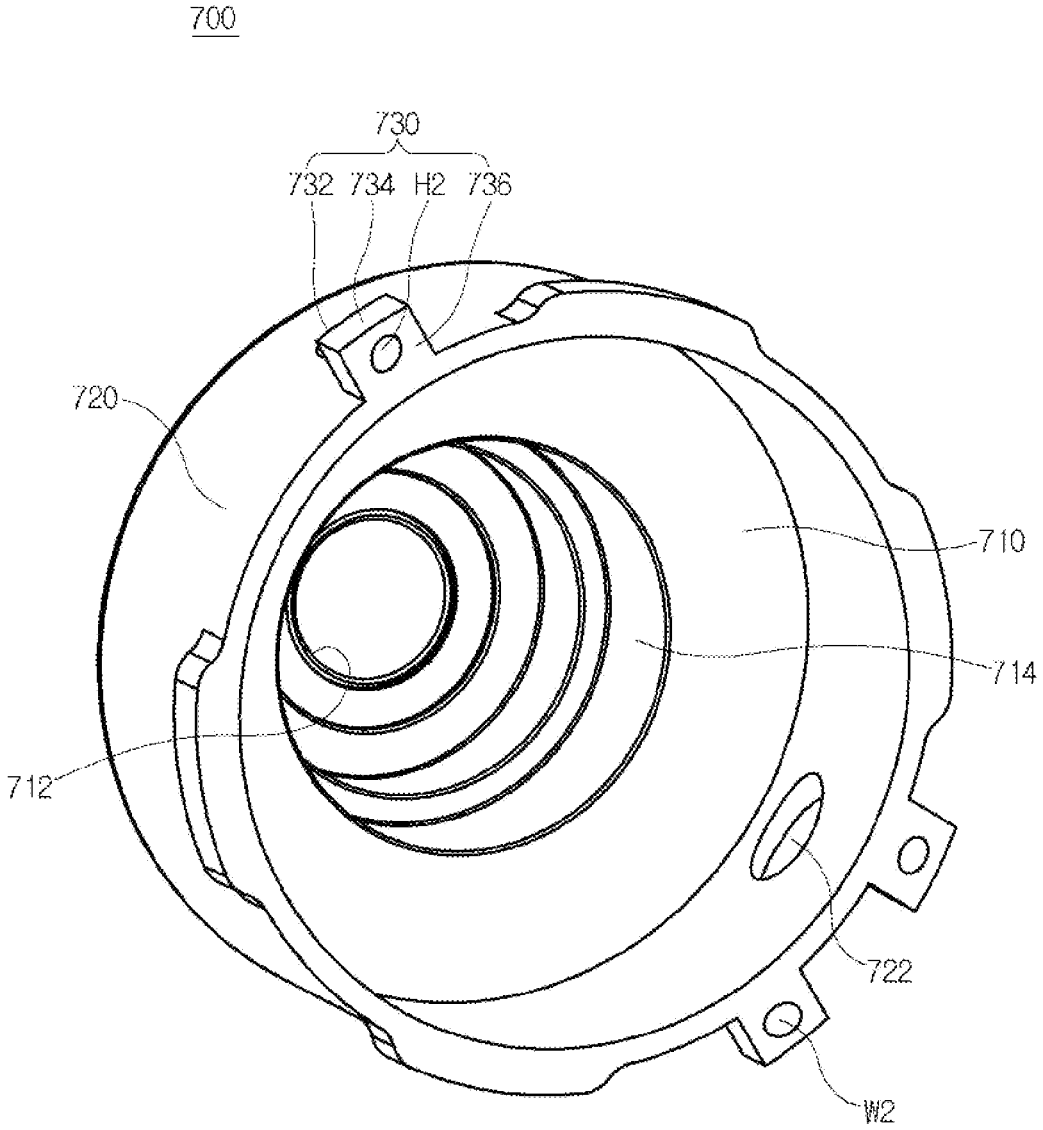
FIG. 6 is a perspective view showing a main frame in the scroll compressor of FIG. 2.
Figure 7:
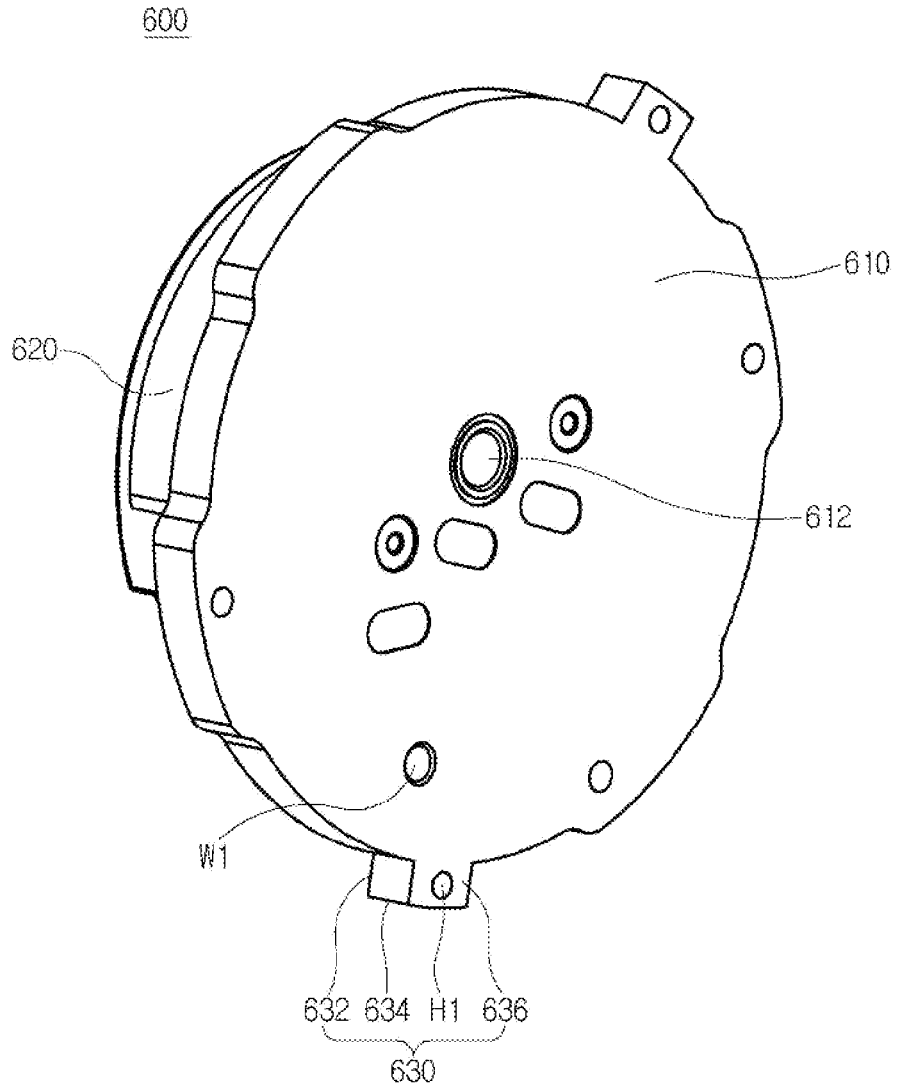
FIG. 7 is a perspective view showing a fixed scroll in the scroll compressor of FIG. 2.
Figure 8:
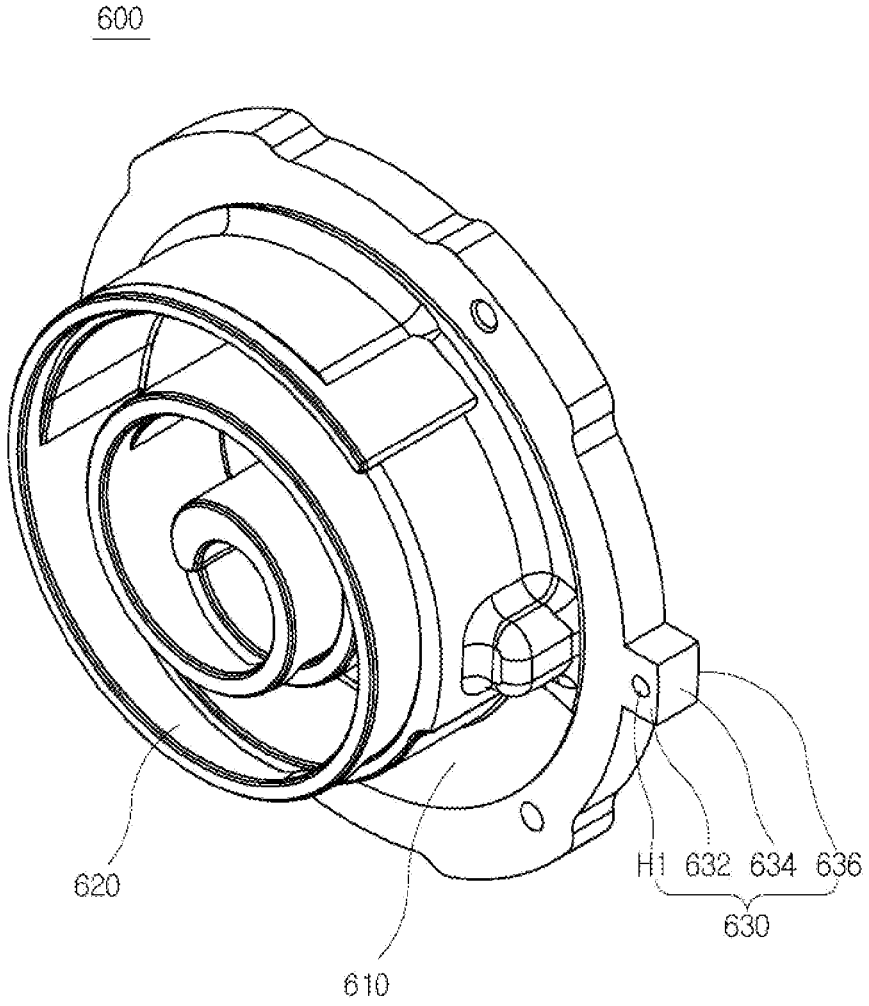
FIG. 8 is a perspective view showing a back side of FIG. 7.
Figure 9:
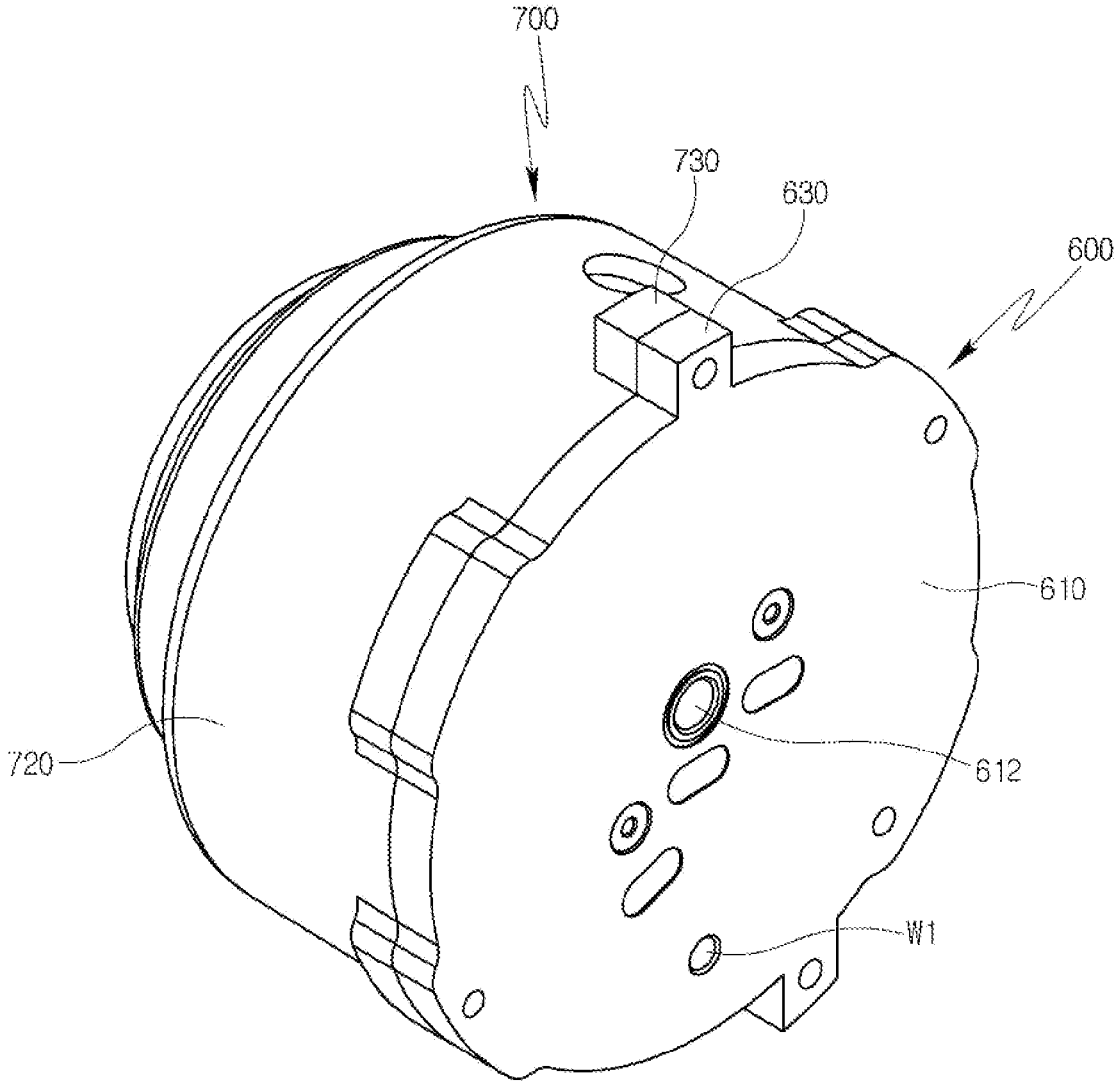
FIG. 9 is a perspective view showing that the main frame of FIG. 6 and the fixed scroll of FIG. 7 have been coupled.

FIG. 2 is a cross-sectional view showing a scroll compressor according to an embodiment of the present invention. FIG. 3 is an enlarged view of a part "A" of FIG. 2. FIG. 4 is a cross sectional view showing the scroll compressor of FIG. 2 cut in another direction. FIG. 5 is a perspective view showing a first casing in the scroll compressor of FIG. 2. FIG. 6 is a perspective view showing a main frame in the scroll compressor of FIG. 2. FIG. 7 is a perspective view showing a fixed scroll in the scroll compressor of FIG. 2. FIG. 8 is a perspective view showing a back side of FIG. 7. FIG. 9 is a perspective view showing that the main frame of FIG. 6 and the fixed scroll of FIG. 7 have been coupled. FIG. 9 is a perspective view showing that the main frame of FIG. 6 and the fixed scroll of FIG. 7 have been coupled.

Referring to the attached FIGS. 2 to 9, the scroll compressor according to the embodiment of the present invention may include a casing 100, a motor 200 which generates a rotational force within the casing 100, a rotary shaft 300 which is rotated by the motor 200, an orbiting scroll 500 which performs an orbiting motion by means of the rotary shaft 300, a fixed scroll 600 which is meshed with the orbiting scroll 500 and forms a pair of two compression chambers C, and a main frame 700 which supports the orbiting scroll 500.

The casing 100 may include a first casing 110 which has a receiving space S in which the motor 200, the rotary shaft 300, the orbiting scroll 500, the fixed scroll 600, and the main frame 700 are received, and a second casing 120 which is fastened to the first casing 110 and covers the receiving space S.

The first casing 110 may include a first casing end plate 112 which supports one end of the rotary shaft 300, and a first casing side plate 114 which protrudes from an outer circumferential portion of the first casing end plate 112 toward the second casing 120 and supports the motor 200, the main frame 700, and the fixed scroll 600.

The first casing end plate 112 may be formed in an approximate disk shape, and may include a rotary shaft support groove which is formed in an approximate disk shape and into which one end of the rotary shaft 300 is inserted on a center side of the first casing end plate 112.

The first casing side plate 114 may be formed in an approximately annular shape, and may include a suction port (not shown) which communicates with a refrigerant suction pipe (not shown) that guides a refrigerant from the outside to the receiving space S (more precisely, a first space S1 to be described later).

Also, a front end of the first casing side plate 114 may include a flange insertion groove 116 which is formed engraved from a front end surface of the first casing side plate 114 and an inner circumferential surface of the first casing side plate 114 such that a fixed scroll flange 630 and a main frame flange 730 which are described later are inserted into.

The flange insertion groove 116 may include a flange insertion groove basal surface 116*a* which is bent from the inner circumferential surface of the first casing side plate 114, and a flange insertion groove inner circumferential surface 116*b* which is bent from the flange insertion groove basal surface 116*a* and extends to the front end surface of the first casing side plate 114.

Also, the flange insertion groove 116 may include a third fastening hole H3 which is formed engraved from the flange insertion groove basal surface 116*a* such that a fastening member 800 to be described later is inserted.

The second casing 120 may include a second casing end plate 122 which faces the fixed scroll 600 and a second casing side plate 124 which protrudes from an outer circumferential portion of the second casing end plate 122 and is fastened to the first casing side plate 114.

The second casing end plate 122 may include a discharge chamber D which receives the refrigerant discharged from the compression chamber C.

Also, the second casing end plate 122 may include a discharge port (not shown) which communicates with a refrigerant discharge pipe (not shown) that guides the refrigerant in the discharge chamber D to the outside.

A front end surface of the second casing side plate 124 may be formed to face the front end surface of the first casing side plate 114 and a fixed scroll flange top surface 636 to be described later, such that the second casing side plate 124 can be fastened to the first casing side plate 114 and such that the fixed scroll flange 630 to be described later is prevented from being separated from the flange insertion groove 116. That is, the outer diameter of the second casing side plate 124 may be formed at an equal level to the outer diameter of the first casing side plate 114, and the inner diameter of the second casing side plate 124 may be formed smaller than the inner diameter of the flange insertion groove 116.

Here, the first casing 110 is integrally formed. Since the main frame 700 is formed to be attachable to and detachable from the first casing 110, even when the first casing 110 is integrally formed, the motor 200, the rotary shaft 300, the orbiting scroll 500, and the fixed scroll 600 may be inserted from the second casing 120 side to the first casing 110 side and may be received in the receiving space S. That is, the motor 200 and the rotary shaft 300 may be first inserted into the receiving space S. Then, as the main frame 700 is inserted into the receiving space S, the receiving space S may be divided into the first space S1 in which the motor 200 is received and a second space S2 in which the orbiting scroll 500 and the fixed scroll 600 are received. Then, an eccentric bush 400 which causes the orbiting scroll 500 to orbit may be inserted into the receiving space S (more precisely, the second space S2) and be fastened to the rotary shaft 300, and the orbiting scroll 500 may be inserted into the receiving space S (more precisely, the second space S2) and be fastened to the eccentric bush 400. Then, the fixed scroll 600 may be inserted into the receiving space S (more precisely, the second space S2). Then, the second casing 120 may be fastened to the first casing 110 to cover the receiving space S.

On the other hand, since leakage may occur between the front end surface of the first casing side plate 114 and the front end surface of the second casing side plate 124, a sealing member 900 which seals the receiving space S from the outside of the casing 100 is formed between the front end surface of the first casing side plate 114 and the front end surface of the second casing side plate 124.

The motor 200 may include a stator which is fixed to the first casing side plate 114 and a rotor which is rotated within the stator by interaction with the stator.

The rotary shaft 300 is fastened to the rotor and passes through the central portion of the rotor, so that one end of the rotary shaft 300 may pass through the main frame 700, and the other end of the rotary shaft 300 may be supported by the first casing end plate 112.

The orbiting scroll 500 may include a disk-shaped orbiting scroll end plate 510, an orbiting scroll wrap 520 which protrudes from the center of the orbiting scroll end plate 510 toward the fixed scroll 600, and an orbiting scroll boss 530 which protrudes from the center of the orbiting scroll end plate 510 to the opposite side of the orbiting scroll wrap 520 and is fastened to the eccentric bush 400.

The fixed scroll 600 may include a disk-shaped fixed scroll end plate 610, a fixed scroll wrap 620 which protrudes from the center of the fixed scroll end plate 610 and is meshed with the orbiting scroll wrap 520, and a fixed scroll flange 630 which protrudes from the outer circumferential surface of the fixed scroll end plate 610 in a radial direction and is inserted into the flange insertion groove 116 of the first casing 110.

Here, the fixed scroll end plate 610, the fixed scroll wrap 620, and the fixed scroll flange 630 may form the appearance of the fixed scroll 600.

A discharge hole 612 which discharges the refrigerant in the compression chamber C to the discharge chamber D may be formed on the center side of the fixed scroll end plate 610.

The fixed scroll flange 630 is for fastening the fixed scroll 600 to the first casing 110, and may be formed to be fastened to the first casing 110 in a state of being inserted together with the main frame flange 730 to be described later into the flange insertion groove 116.

Specifically, the fixed scroll flange 630 may include a fixed scroll flange basal surface 632 which contacts with a main frame flange top surface 736 to be described later, a fixed scroll flange outer circumferential surface 634 which is bent from the fixed scroll flange basal surface 632 and faces the flange insertion groove inner circumferential surface 116*b*, a fixed scroll flange top surface 636 which is bent from the fixed scroll flange outer circumferential surface 634 and forms a back side of the fixed scroll flange basal surface 632, and a first fastening hole H1 which passes through the fixed scroll flange 630 from the fixed scroll flange top surface 636 to the fixed scroll flange basal surface 632.

The main frame 700 may include a main frame end plate 710 which is provided on the opposite side of the fixed scroll end plate 610 on the basis of the orbiting scroll 500, a main frame side plate 720 which protrudes from an outer circumferential portion of the main frame end plate 710 toward the fixed scroll 600, and a main frame flange 730 which protrudes from an outer circumferential surface of the main frame side plate 720 in a radial direction and is insert6ed into the flange insertion groove 116 of the first casing 110.

Here, the main frame end plate 710, the main frame side plate 720, and the main frame flange 730 may form the appearance of the main frame 700.

The main frame end plate 710 may provide a shaft receiving hole 712 through which one end of the rotary shaft 300 passes, and a back pressure chamber 714 which provides a space in which the eccentric bush 400 which is fastened to the one end of the rotary shaft 300 can be rotated and presses the orbiting scroll 500 toward the fixed scroll 600.

The main frame side plate 720 may provide a suction hole 722 which passes through the main frame side plate 720 in such a way as to guide the refrigerant introduced into the first space S1 through the refrigerant suction pipe (not shown) to the compression chamber C, and communicates the first space S1 and the second space S2.

The main frame flange 730 is for fastening the main frame 700 to the first casing 110, and may be formed to be fastened to the first casing 110 in a state of being inserted together with the fixed scroll flange 630 into the flange insertion groove 116.

Specifically, the main frame flange 730 may include a main frame flange basal surface 732 which contacts with the flange insertion groove basal surface 116*a*, a main frame flange outer circumferential surface 734 which is bent from the main frame flange basal surface 732 and faces the flange insertion groove inner circumferential surface 116*b*, a main frame flange top surface 736 which is bent from the main frame flange outer circumferential surface 734 and forms a back side of the main frame flange basal surface 732, and a second fastening hole H2 which passes through the main frame flange 730 from the main frame flange top surface 736 to the main frame flange basal surface 732.

Here, the main frame flange 730 and the fixed scroll flange 630 are fastened to the first casing side plate 114 by a fastening member 800 that is inserted into the first fastening hole H1, the second fastening hole H2, and the third fastening hole H3.

Hereinafter, the operation effects of the scroll compressor according to the present embodiment will be described.

That is, when the power is applied to the motor 200, the rotary shaft 300 may rotate together with the rotor.

Also, the orbiting scroll 500 may be orbited by receiving a rotational force from the rotary shaft 300 through the eccentric bush 400.

Accordingly, the volume of the compression chamber C may be reduced while continuously moving toward the center side.

Also, the refrigerant may flow into the second space S2 through the refrigerant suction pipe (not shown), the first space S1 and the suction hole 722.

Also, the refrigerant introduced into the second space S2 may be sucked into the compression chamber C.

Also, the refrigerant sucked into the compression chamber C may be compressed while being moved to the center side along the moving path of the compression chamber C and be discharged to the discharge chamber D through the discharge hole 612.

Also, the refrigerant discharged to the discharge chamber D may be discharged to the outside of the compressor through the refrigerant discharge pipe (not shown).

Here, in the scroll compressor according to the embodiment of the present embodiment, as the orbiting scroll 500 and the fixed scroll 600 are received within the casing 100, noise generated in the compression chamber C can be reduced by the casing. Accordingly, the noise generated in the compression chamber C can be prevented from being emitted to the outside of the casing 100.

Also, the fixed scroll end plate 610, the main frame end plate 710, and the main frame side plate 720 form an orbiting space of the orbiting scroll 500, and the main frame side plate 720 is interposed between the casing 100 and the orbiting scroll 500. Therefore, the noise generated in the compression chamber C may also be reduced by the main frame side plate 720. As a result of this, the noise generated in the compression chamber C can be further prevented from being emitted to the outside of the casing 100.

On the other hand, as the fixed scroll end plate 610, the main frame end plate 710, and the main frame side plate 720 form the orbiting space of the orbiting scroll 500 and the main frame side plate 720 which is fastened to the first casing 110 through the main frame flange 730 is interposed between the casing 100 and the orbiting scroll 500, an orbiting radius of the orbiting scroll 500 may increase.

Specifically, the main frame side plate 720 may not be directly fastened to the first casing 110, but may be fastened to the first casing 110 through the main frame flange 730. Accordingly, the main frame side plate 720 does not have a fastening hole into which the fastening member 800 is inserted. Accordingly, even though the main frame side plate 720 has a thin radial thickness, the rigidity of the main frame side plate 720 can be ensured. That is, for example, the radial thickness of the main frame side plate 720 may be smaller than that of the first casing side plate 114. Accordingly, the orbiting radius of the orbiting scroll 500 may be formed to the maximum degree within a range in which the orbiting scroll 500 does not interfere with the main frame side plate 720.

Accordingly, the discharge amount of the refrigerant may be increased while maintaining the height of the compression chamber C in the axial direction at a predetermined level. That is, the discharge amount of the refrigerant may be increased while maintaining the rigidity of the orbiting scroll wrap 520 and the fixed scroll wrap 620 at a predetermined level.

Alternatively, the outer diameter of the first casing side plate 114 may be reduced while maintaining the discharge amount of the refrigerant at a predetermined level. Accordingly, the weight and cost of the scroll compressor can be reduced and vehicle mountability can be improved.

Meanwhile, as the main frame 700 is formed to be attachable to and detachable from the casing 100, the first casing 110 may be integrally formed. Accordingly, it is enough as long as the receiving space S is sealed only by the sealing member 900 interposed between the first casing 110 and the second casing 120, so that the cost can be reduced and the risk of leakage can be significantly reduced.

Meanwhile, the scroll compressor according to the embodiment of the present embodiment can be formed such that oil flows together with a refrigerant within the casing 100 and various sliding portions can be lubricated.

Specifically, oil is stored in the first space S1. The oil in the first space S1 flows, together with the refrigerant in the first space S1, into the compression chamber C, and the oil contained in the refrigerant discharged from compression chamber C to the discharge chamber D is separated in the discharge chamber D. The oil separated from the refrigerant in the discharge chamber D may flow into the first space S1 and the back pressure chamber 714 through an oil recovery passage W.

The oil recovery passage W may include a first oil passage hole W1 which passes through the fixed scroll end plate 610 and communicates with the discharge chamber D such that the oil in the discharge chamber D is introduced, a second oil passage hole W2 which passes through the main frame side plate 720 and communicates with the first oil passage hole W1 such that the oil in the first oil passage hole W1 is introduced, a first decompression member R1 which is provided within the second oil passage hole W2 such that the pressure of the oil passing through the second oil passage hole W2 is reduced from a discharge pressure to an intermediate pressure, a third oil passage hole W3 which passes through the main frame end plate 710 and communicates the second oil passage hole W2 and the first space S1 such that a part of the oil which has passed through the second oil passage hole W2 is guided to the first space S1, a second decompression member R2 which is provided within the third oil passage hole W3 such that the pressure of the oil passing through the third oil passage hole W3 is reduced from the intermediate pressure to a suction pressure, and a fourth oil passage hole W4 which passes through the main frame end plate 710 and communicates the second oil passage hole W2 and the back pressure chamber 714 such that a part of the oil which has passed through the second oil passage hole W2 is guided to the back pressure chamber 714.

Here, in the present embodiment, since the main frame 700 includes the main frame side plate 720, it may be easy to form the oil recovery passage W.

The invention claimed is:

1. A scroll compressor comprising:

a casing;

a motor which generates a rotational force within the casing;

a rotary shaft which is rotated by the motor;

an orbiting scroll which performs an orbiting motion by means of the rotary shaft;

a fixed scroll which is meshed with the orbiting scroll and forms a pair of compression chambers; and a main frame which supports the orbiting scroll, wherein the fixed scroll further comprises a fixed scroll end plate and a fixed scroll wrap which protrudes from the fixed scroll end plate, wherein the main frame further comprises:

a main frame end plate which is provided on an opposite side of the orbiting scroll from the fixed scroll; and a main frame side plate which protrudes from an outer circumferential portion of the main frame end plate toward the fixed scroll, wherein the fixed scroll end plate, the main frame end plate, and the main frame side plate form an orbiting space of the orbiting scroll, wherein the main frame side plate is interposed between the casing and the orbiting scroll, wherein the orbiting scroll comprises an orbiting scroll end plate and an orbiting scroll wrap which protrudes from the orbiting scroll end plate toward the fixed scroll and is meshed with the fixed scroll wrap, and wherein the orbiting scroll end plate and the orbiting scroll wrap face the main frame side plate in a radial direction, wherein the fixed scroll further comprises a fixed scroll flange which protrudes from an outer circumferential surface of the fixed scroll end plate in a radial direction and is fastened to the casing, and wherein the main frame further comprises a main frame flange which protrudes from an outer circumferential surface of the main frame side plate in a radial direction and is fastened to the casing.

2. The scroll compressor of claim 1, wherein the main frame side plate is formed thinner than the casing.

3. The scroll compressor of claim 1, wherein the casing further comprises:

a first casing which has a receiving space in which the motor, the rotary shaft, the orbiting scroll, the fixed scroll, and the main frame are received; and a second casing which is fastened to the first casing and covers the receiving space.

4. The scroll compressor of claim 3, wherein the first casing comprises:

a first casing end plate which supports an end of the rotary shaft; and a first casing side plate which protrudes from an outer circumferential portion of the first casing end plate toward the second casing and supports the motor, the main frame, and the fixed scroll.

5. The scroll compressor of claim 4, wherein the first casing side plate further comprises a flange insertion groove into which the fixed scroll flange and the main frame flange are inserted.

6. The scroll compressor of claim 5, wherein the flange insertion groove comprises:

a flange insertion groove basal surface which is bent from an inner circumferential surface of the first casing side plate; and a flange insertion groove inner circumferential surface which is bent from the flange insertion groove basal surface and extends to a front end surface of the first casing side plate.

7. The scroll compressor of claim 6, wherein the main frame flange further comprises:

a main frame flange basal surface which contacts with the flange insertion groove basal surface;

a main frame flange outer circumferential surface which is bent from the main frame flange basal surface and faces the flange insertion groove inner circumferential surface; and a main frame flange top surface which is bent from the main frame flange outer circumferential surface and forms a back side of the main frame flange basal surface.

8. The scroll compressor of claim 7, wherein the fixed scroll flange further comprises:

a fixed scroll flange basal surface which contacts with the main frame flange top surface;

a fixed scroll flange outer circumferential surface which is bent from the fixed scroll flange basal surface and faces the flange insertion groove inner circumferential surface; and a fixed scroll flange top surface which is bent from the fixed scroll flange outer circumferential surface and forms a back side of the fixed scroll flange basal surface.

9. The scroll compressor of claim 8, wherein the fixed scroll flange further comprises a first fastening hole which passes through the fixed scroll flange from the fixed scroll flange top surface to the fixed scroll flange basal surface, wherein the main frame flange comprises a second fastening hole which passes through the main frame flange from the main frame flange top surface to the main frame flange basal surface, wherein the flange insertion groove comprises a third fastening hole which is formed engraved from the flange insertion groove basal surface, and wherein the main frame flange and the fixed scroll flange are fastened to the first casing side plate by a fastening member that is inserted into the first fastening hole, the second fastening hole, and the third fastening hole.

10. The scroll compressor of claim 3, wherein the motor, the rotary shaft, the orbiting scroll, the fixed scroll, and the main frame are inserted from a side of the second casing into a side of the first casing, and then are received in the receiving space.

11. The scroll compressor of claim 3, wherein a sealing member which seals the receiving space from outside of the casing is formed between the first casing and the second casing, and wherein the receiving space is sealed only by the sealing member.

12. The scroll compressor of claim 1, further comprising an oil recovery passage which recovers oil which is separated from a refrigerant discharged from the compression chambers, wherein the oil recovery passage is formed on the main frame side plate.

* * * * *